US009039496B2

(12) United States Patent
Kolthoff

(10) Patent No.: US 9,039,496 B2
(45) Date of Patent: May 26, 2015

(54) GRINDING DISK

(71) Applicant: Kolthoff & Co., Flüelen (CH)

(72) Inventor: Dieter Kolthoff, Flüelen (CH)

(73) Assignee: Kolthoff Gabrovo EOOD, Gabrovo (BG)

( * ) Notice: Subject to any disclaimer, the term of this patent is extended or adjusted under 35 U.S.C. 154(b) by 289 days.

(21) Appl. No.: 13/717,735

(22) Filed: Dec. 18, 2012

(65) Prior Publication Data

US 2013/0157552 A1 Jun. 20, 2013

(30) Foreign Application Priority Data

Dec. 20, 2011 (DE) ..... 20 2011 109 293 U

(51) Int. Cl.

| | |
|---|---|
| ***B24B 7/18*** | (2006.01) |
| ***B24B 23/02*** | (2006.01) |
| ***B24D 9/08*** | (2006.01) |
| ***B24D 7/16*** | (2006.01) |

(52) U.S. Cl.

CPC . *B24D 7/16* (2013.01); *B24B 7/186* (2013.01); *B24B 7/18* (2013.01); *B24B 23/02* (2013.01); *B24D 9/08* (2013.01)

(58) Field of Classification Search

CPC ..... B24B 7/18; B24B 7/186; B24B 23/02; B24B 23/028; B24B 41/047; B24B 55/102; B24D 9/08

USPC ..... 451/353, 359, 508, 548

See application file for complete search history.

(56) References Cited

U.S. PATENT DOCUMENTS

| | | | | | |
|---|---|---|---|---|---|
| 1,778,470 | A * | 10/1930 | Stratford | 451/511 |
| 2,119,738 | A * | 6/1938 | Dempsey | 451/511 |
| 2,993,311 | A * | 7/1961 | West | 464/120 |
| 3,416,265 | A * | 12/1968 | Marton | 451/513 |
| 4,058,936 | A * | 11/1977 | Marton | 451/359 |
| 4,065,882 | A * | 1/1978 | D'Urso | 451/513 |
| 4,138,804 | A * | 2/1979 | Thielen | 451/342 |
| 5,609,516 | A * | 3/1997 | Courson et al. | 451/456 |
| 6,159,084 | A * | 12/2000 | Tiede | 451/357 |
| 6,857,949 | B2 * | 2/2005 | Reich et al. | 451/357 |
| 8,602,850 | B2 * | 12/2013 | Park et al. | 451/359 |
| 2004/0053569 | A1 * | 3/2004 | Mueller | 451/359 |
| 2005/0090191 | A1 * | 4/2005 | Sun et al. | 451/359 |

(Continued)

FOREIGN PATENT DOCUMENTS

| | | |
|---|---|---|
| DE | 20 2009 000 880 U1 | 8/2009 |
| DE | 10 2010 012 007 A1 | 9/2011 |

*Primary Examiner* — Eileen Morgan

(74) *Attorney, Agent, or Firm* — Gudrun E. Huckett

(57) ABSTRACT

A grinding disk in particular for rotary fine machining of surfaces has a support plate and a drive connector connecting the grinding disk to a rotary drive machine. The drive connector is provided at a top side of the support plate. An elastically deformable cushion is disposed at a bottom side of the support plate. The cushion is covered with a working medium or with an adhesive coating for detachable attachment of a working medium disk. A cover is disposed on the support plate so as to define an axial intermediate spacing, wherein the cover is embodied as a mechanically loadable structural part and is connected fixedly at least to an outer rim of the support plate. Primarily radially extending ribs are disposed between the support plate and the cover and connected at least at some locations with the support plate and the cover.

13 Claims, 7 Drawing Sheets

(56) References Cited

U.S. PATENT DOCUMENTS

2005/0153637 A1* 7/2005 Janson ..... 451/359
2006/0068689 A1* 3/2006 Kiss et al. ..... 451/359
2006/0229005 A1* 10/2006 Gautier et al. ..... 451/359
2011/0045749 A1* 2/2011 Harris et al. ..... 451/359

* cited by examiner

GRINDING DISK

BACKGROUND OF THE INVENTION

The invention relates to a grinding disk in particular for rotary fine machining of surfaces. The grinding disk comprises a support plate having a top-side drive connector for connecting the grinding disk to a rotating drive machine. The support plate is provided with an elastically deformable cushion that is at the bottom side covered with a working medium or with an adhesive coating for releasable attachment of a working medium disk. The support plate is provided with a cover that is positioned at an axial intermediate spacing to the support plate.

Such a grinding disk is disclosed, for example, in German utility model 20 2009 000 880 U1. Grinding disks of this kind are typically attached to rotating driving machines such as power drills or grinding machines in order to support a working medium disk that is to be moved in rotation with the grinding disk concentrically or even eccentrically.

In principle, the working medium disk is embodied as a wear part with material expenditure as little as possible and therefore is provided with little inherent stiffness. The support of the working medium disk by the grinding disk provides generally a yielding action for adaptation to the surfaces to be machined that is generally provided as a coating in the form of an elastically deformable cushion. However, as a whole a stiff configuration of the grinding disk is required in order to be able to perform the grinding or polishing movements in a controlled fashion and, primarily, to prevent in case of great work loads deformations that could cause the grinding disk to contact the driving machine.

The stiffness requirement is however contrary to the need for a lightweight construction that facilitates handling as the working movements are carried out and that, in case of eccentric grinding machines, complies with weight limits which should not be exceeded with respect to a mass compensation for eccentric and vibration systems.

Another configuration of a grinding disk is disclosed in DE 10 2010 012 007 A1 according to which the manufacture of suction passages in the grinding disk is to be simplified. This configuration has no cover and provides, between a support plate provided with the top-side drive connector and an elastically deformable cushion, a hollow air guiding part of plastic material that is attached underneath the support plate before the cushion is applied by foaming. In this way, the deformable cushion and the support plate are immediately connected to each other only along the rim and the static and dynamic work loads are primarily transmitted through the air guiding part. This results in a reduced stiffness and/or a massive and heavy construction.

It is the object of the present invention to provide a grinding disk that is developed further, on the one hand, to have a high inherent stiffness and, on the other hand, is provided with a reduced weight but is conventionally robust and can be used easily and also can be manufactured by mass production.

SUMMARY OF THE INVENTION

In accordance with the present invention, this is achieved in that the grinding disk has a cover that is embodied as a mechanically loadable structural part and is fixedly connected at least on an outer rim with the support plate and in that, between the support plate and the cover, primarily radially extending webs are arranged and are fixedly connected with the support plate as well as with the cover at least at some locations.

With a further development of the grinding disk comprises a load-bearing cover as a loadable structural part that at least at the outer rim is fixedly connected to the support plate and further comprises, between support plate and cover, primarily radially extending webs that are fixedly connected entirely or partially, a stiff spatial structure results that still can be realized easily because of the hollow structure between cover and support plate. Such a structure is suitable to introduce the rotary or eccentric movements that are imparted by the top-side drive connector into the elastically deformable cushion across the surface area and to also transmit them to the mainly loaded rim areas of the grinding disk. It is however also suitable to transmit contact pressure forces of the grinding disk occurring at the edges in a stiff way, i.e., with minimal deformation, to the drive connector. The relatively lightweight and stiff configuration of the grinding disk is mechanically loadable, compact, and movable in eccentric systems.

In the grinding disk in accordance with the prior art reference DE 20 2009 000 880 U1 the cover is expressly not to be exposed to any particular mechanical loads and is locked only by stilt-like spacer elements in matching holes of the support plate; in contrast to this, the cover of the present invention is incorporated in the strength and stiffness concept of the grinding disk and is connected at the rim but also across the surface in a load-bearing function to the support plate. area. This decisive development step to a loadable total structure makes it however possible also to utilize the manufacturing technologies employed already in the prior art. In particular, support plate and cover can be produced precisely in a molding method, for example, as an injection molded part, from plastic material and can be joined. Support plate and/or cover can be embodied with fiber reinforcement as an injection molded part that is imparted by the fibers, for example, glass fibers or carbon fibers, with increased strength. Even higher strengths can be provided by resin-bonded fiberglass mats (fiberglass composite) or carbon fiber mats that can also be manufactured precisely in molds and that can be exactly shaped already during the molding process to have the connecting areas required for connecting support plate and cover.

Advantageously, cover and support plate are to be connected with each other and with the webs by material fusion. For example, fusing or welding or adhesive connections can be provided with known means of the art. In addition or as an alternative, for providing a fixed connection of cover and support plate, fastening elements such as screws, rivets and the like can be used also that, with a sufficiently tight distribution of the fastening locations, can also provide the advantages of a closed strong box structure.

Advantageously, the webs at one side are formed monolithically with the cover or with the support plate so that the webs are no longer to be treated as individual elements or a separate spacer and connector system.

In addition to the webs, a fixed connection of cover and support plate on the rim provides also a significant contribution to stiffness and strength. In this connection, the cover can be annular (ring-shaped) and can be fused (welded) or glued at the inner circumference as well as at the outer circumference with the support plate. Such an adhesive connection can also be aided by form fit when, for example, the cover is recessed into the support plate at its outer circumference so as to be flush with the support plate and is resting in radial direction precisely with an outer edge against the inner edge of the support plate. The same form fit can be provided for an annular cover on its inner rim (inner circumference). It is understood that such an additional form fit can be supplemented further by a complex engagement of annular webs and annular grooves.

The hollow spaces between cover and support plate at the level of the webs can be filled with a lightweight but strong material; the lightweight but strong material, for example, in the form of rigid plastic foam, can be inserted in tailored configuration and glued into the hollow spaces. Preferably, however, it is introduced in a foaming process in a pressure mold and foamed so that it fills the hollow spaces and at the same time adhesively attaches to the cover, the support plate and the webs. A tried and proven material in this context exists, for example, in the form of a polyurethane foam.

For the given structure of the grinding disk with an especially lightweight configuration the rotational and bending loads that are applied onto the grinding disk come together at the top-side drive connector that is to be positioned, as is conventional in the support plate and therefore positioned in the downwardly facing component of the grinding disk provided with the cushion. This ensures in particular that overloading of the support plate in operation and a resulting destruction of the structure maintains the connection between drive connector and support plate. A cover that upon destruction would become detached would be secured at least in loose form between support plate and drive machine. In comparison, the detachment of the elastically deformable cushion and of the working medium is generally not dangerous given their minimal weight.

The drive connector can be embodied as a screw part or a clamping pin. In the simplest case, the drive connector is embodied in the form of an annular disk that is embedded with its rim in the support plate and enables passage of clamping means. The drive connector is to be provided preferably as a metal element, in particular a steel element, in order to obtain the desired strength.

BRIEF DESCRIPTION OF THE DRAWING

Two embodiments of the invention are disclosed in the drawings and will be explained in the following in more detail.

DESCRIPTION OF THE PREFERRED EMBODIMENTS

Figure 1:
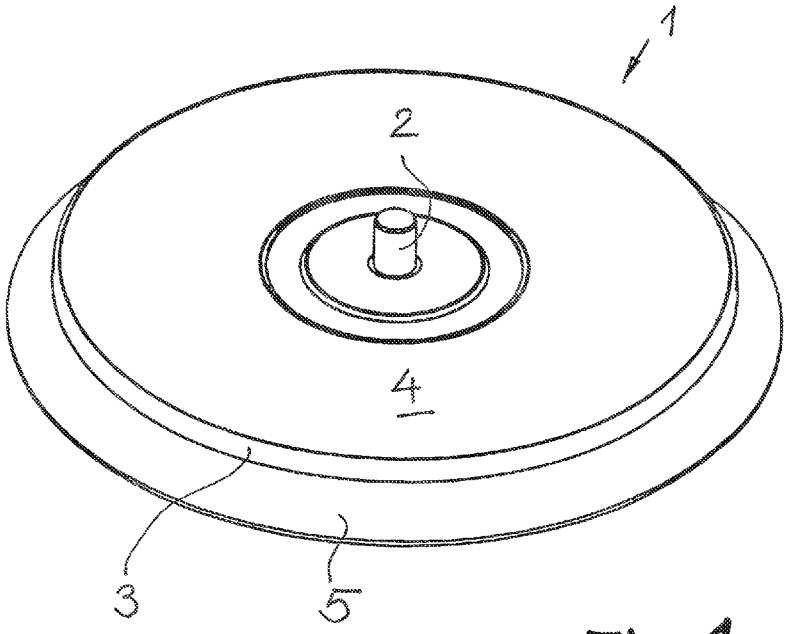
FIG. 1 shows a perspective view of the grinding disk from above.
Figure 2:
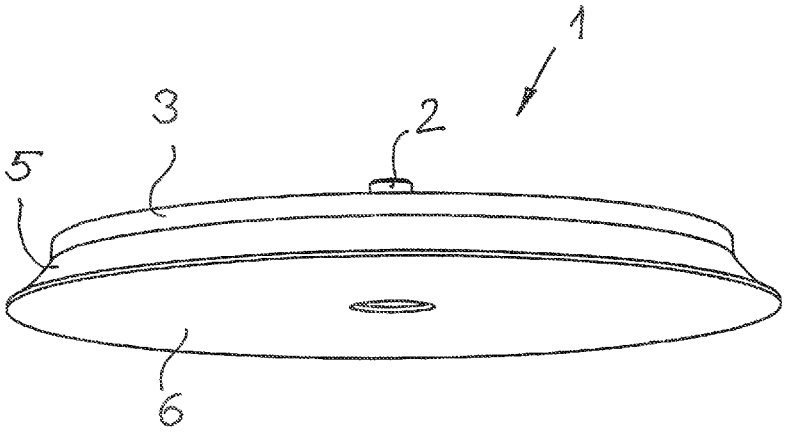
FIG. 2 shows a perspective view of the grinding disk according to FIG. 1 from below.
Figure 3:
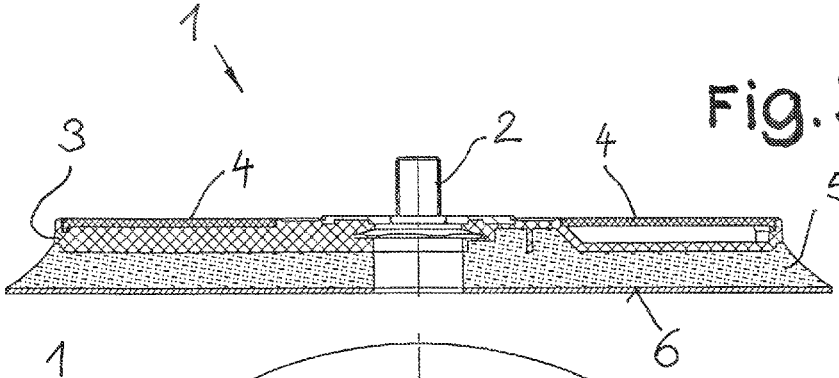
FIG. 3 shows a section illustration of the grinding disk according to FIGS. 1 and 2 (section according to section line III-III of FIG. 4).
Figure 4:
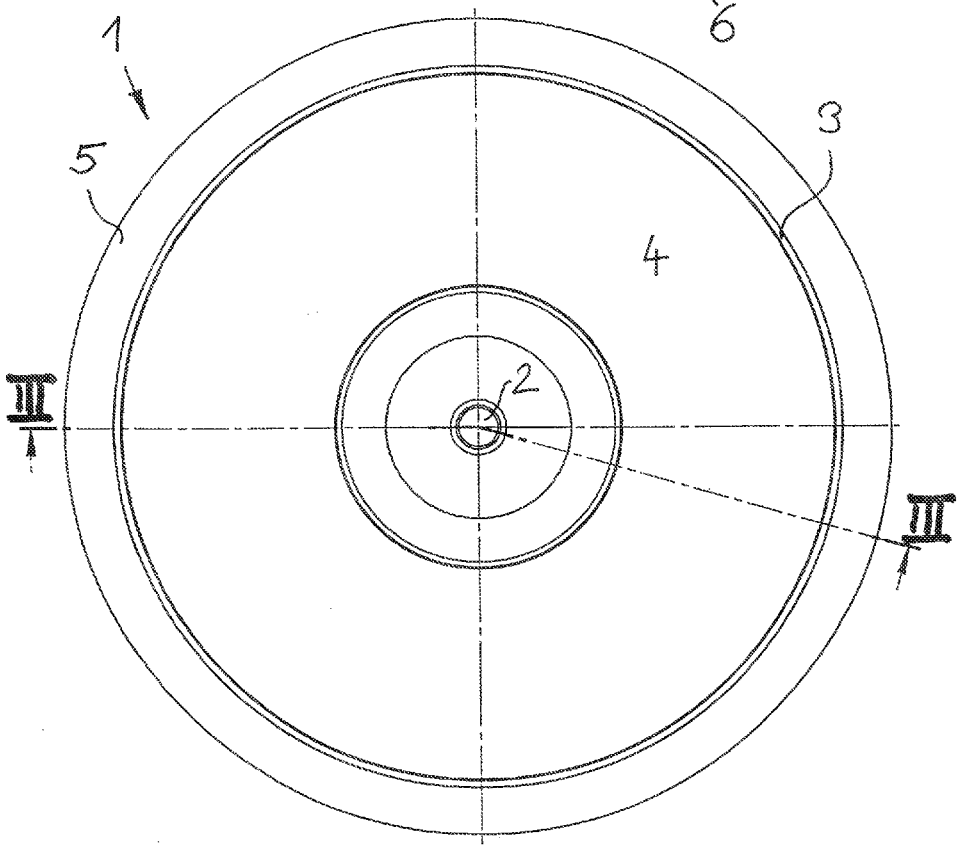
FIG. 4 is a plan view of the grinding disk according to FIGS. 1 to 3.

A grinding disk that is referenced in FIGS. 1 through 4 as a whole by reference 1 is substantially round and plate-shaped and also provided at the top side with a drive connector 2 for clamping in a power drill or a similar device in order to drive the grinding disk 1 in rotation, optionally eccentrically. At the top side, the grinding disk 1 is provided with a support plate 3 and with cover 4 in an embodiment as lightweight but still as stiff as possible; underneath, a cushion 5 of yielding material, in particular an elastic plastic foam, is arranged that, in turn, has a bottom surface 6 with an adhesive coating in the form of a surface that is embodied to function according to the hook and loop fastener principle or a surface that is provided with a permanent adhesive action. In its basic configuration, the grinding disk is of conventional design. However, the sectioned illustration of FIG. 3 shows already that the support plate 3 and the cover 4 are designed and joined in a special constructive way.

Figure 5:
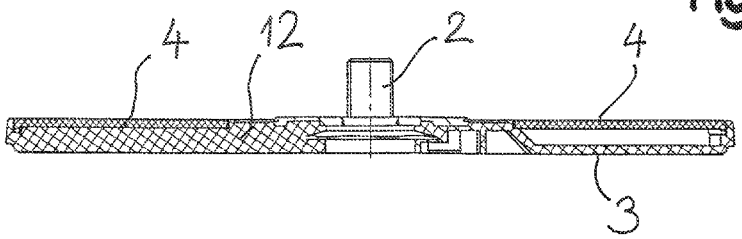
FIG. 5 is a cross-section of the support plate with cover of the grinding disk according to FIG. 1 through 4 (section according to section line V-V of FIG. 6).
Figure 6:
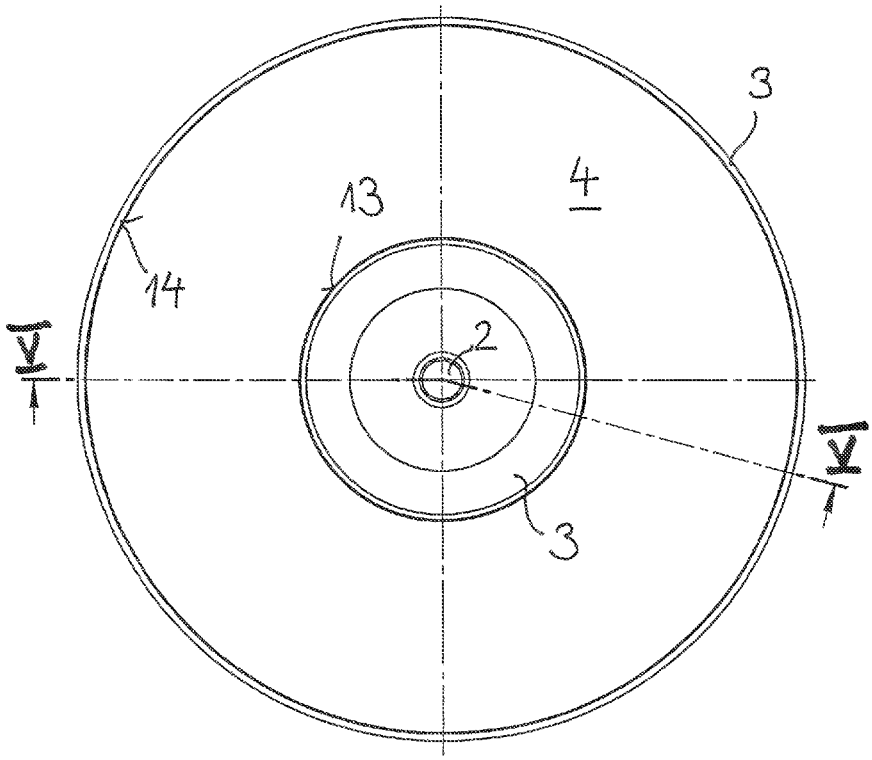
FIG. 6 is a plan view of the support plate with cover of FIG. 5.
Figure 7:
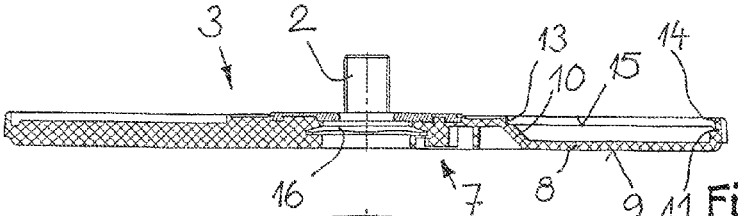
FIG. 7 shows the support plate of FIGS. 5 and 6 without cover in cross-section (section according to section line VII-VII of FIG. 8).
Figure 8:
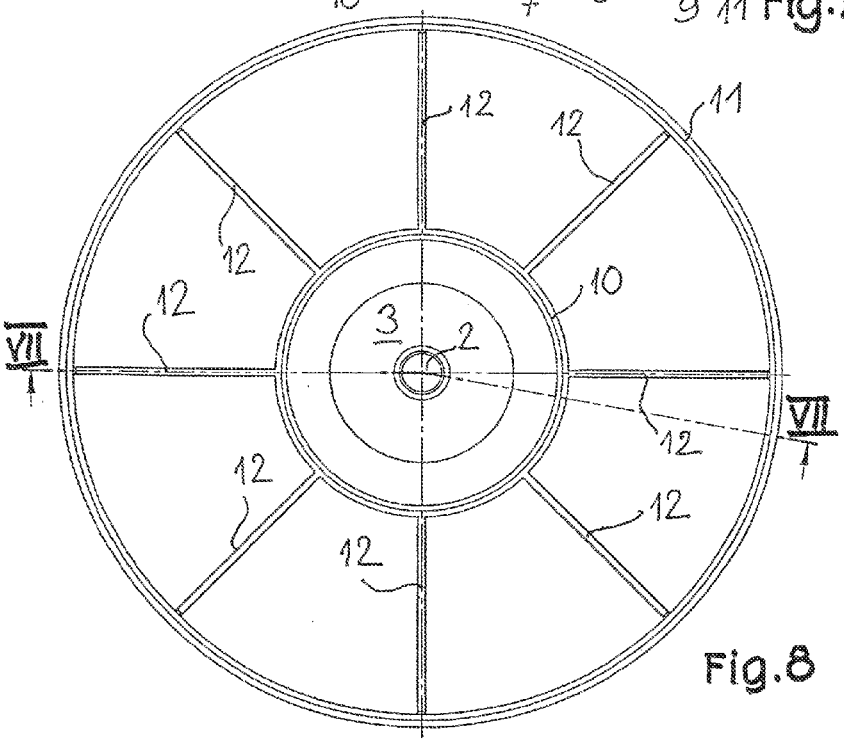
FIG. 8 is a plan view of the support plate according to FIG. 7.
Figure 9:
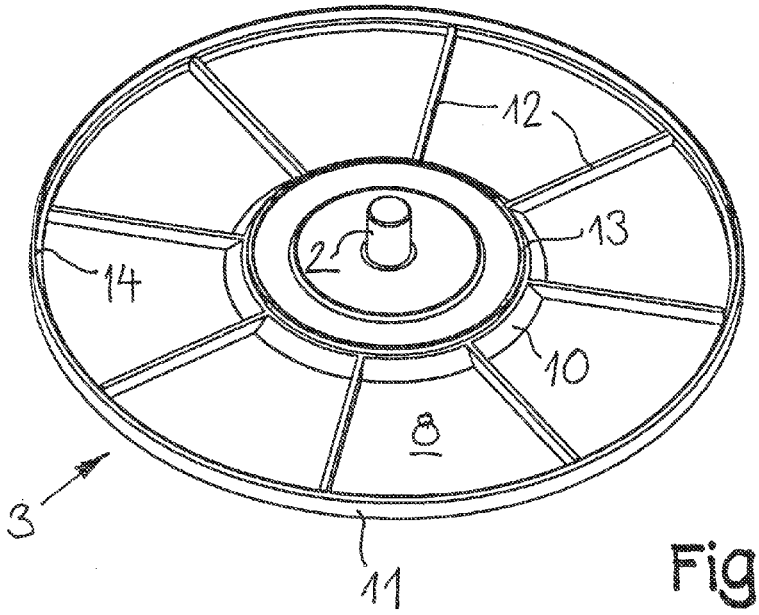
FIG. 9 is a perspective view of the support plate according to FIG. 7 and FIG. 8 from above.

This constructive configuration is illustrated in FIG. 5 in which the cushion 5 is missing that is elastically designed for yielding adaptation of the working medium to the surface to be machined; the illustrated components with support plate 3, cover 4, and drive connector 2 form a rigid unit of high strength while having minimal weight. The support plate 3 is only a part of a support member in conjunction with cover 4 that is fixedly connected to the support plate 3 along several contour lines.

FIGS. 7 through 10 show the support plate 3, without the cover 4, as being formed as a thin-walled shell part which is designed, for reinforcement purposes, by means of a denser rib structure to have a more massive configuration about the central hub area 7, in which also the drive connector 2 is anchored, and which, toward the exterior, passes into a thin-walled shell ring 8 that forms at the bottom side a smooth contact surface 9 for the cushion 5, and radially in the inward direction is provided with a conical annular wall 10 and radially in the outward direction projects upwardly with a circumferential wall 11 in the form of an annular wall. Between these annular walls 10 and 11, radially oriented webs 12 are extending, in the present situation in a sector spacing of 45 degrees relative to each other. The webs 12 are monolithically formed with the support plate 3 and at the top side are reduced in their height by the thickness of the cover 4 so as to end below the top edge of the circumferential wall 11 and also of the annular wall 10 so that the cover 4 is recessed within the support plate and is in a flush arrangement therewith. The cover 4 is sized such that it is form-fittingly resting against an outwardly facing edge 13 of the support plate 3 and is pressed on the radial outwardly positioned side against an inner edge 14 within the circumferential wall 11. For a fixed connection it is however primarily provided that the cover 4 is resting on the upper end face 15 of the webs 12 and is glued or fused or welded thereto. A corresponding fixed or fast connection, preferably by material fusion by gluing or welding (fusing) is also provided within the area of the edges 13 and 14.

In principle, a similar fixed connection can also be provided by means of spot welding or by means of fastening elements applied spot-wise such as screws or rivets. A homogenous strength structure is however obtained in connection with plastic materials preferably by fusing/welding or gluing. The annular exterior area of the support plate 3 with the cover 4 is lightweight and forms at the same time a stiff and strong construction like a box structure.

Figure 10:
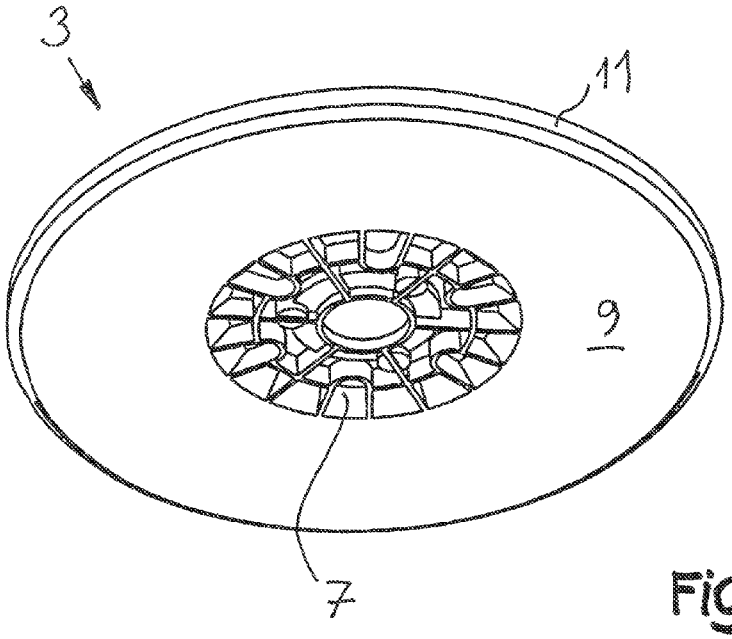
FIG. 10 is a perspective view of the support plate according to FIG. 9 from below.

The inwardly positioned hub area 7, as shown in FIG. 10, is designed in accordance with proper plastic material construction with a dense structure of interconnected ribs of massive configuration in order to embed therein also the drive connector 2. The drive connector 2 in the present embodiment is formed like a shaft stub that passes into a plate-shaped anchoring area 16 of larger diameter with which the drive connector 2 is embedded already during manufacture of the support plate 3. Because of higher break resistance, the drive connector 2 is preferably made of metal, typically steel. In place of a shaft stub that is to be clamped in a drill chuck, other forms of drive connectors, depending on the requirements of the driving or connecting system, can be provided in order to ensure a simple use. In an elementary situation, the drive connector can be embodied as an annular disk which is embedded in the area of a through bore at the center of the support plate and enables clamping by means of a connecting screw or by means of connecting parts at the machine.

As supporting constructive parts the support plate 3 as well as the cover 4 are formed of a strong plastic material or of a fiber-reinforced composite of glass and/or carbon fibers and a plastic matrix. A thermoplastic material enables in this context fusing without additives such as by ultrasonic welding of the contact areas between support plate 3 and cover 4 or at least along a densely arranged sequence of connecting points. In other respects, connections by high-strength adhesive connections are possible also in case of thermoset resin material when, for example, a structure of fiber mats is bonded by synthetic resin. Shaping in a predetermined fixed mold for injection molded parts as well as for composite materials makes it possible to precisely predetermine the connecting areas between support plate and cover with respect to joining technology and to reinforce the structural composite in this way.

Figure 11:
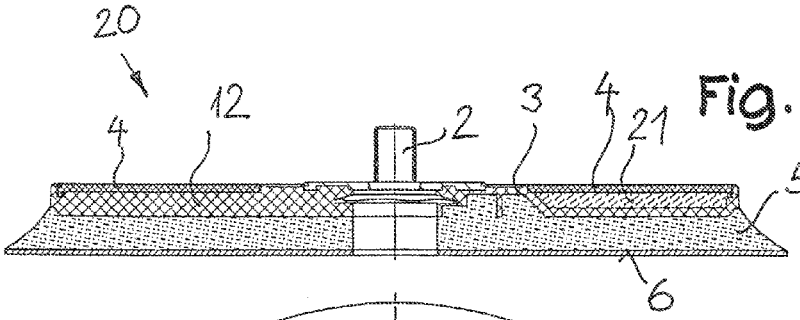
FIG. 11 is a cross-section of a modified embodiment of the grinding disk according to FIGS. 1 through 10 (section according to section line XI-XI of FIG. 12).
Figure 12:
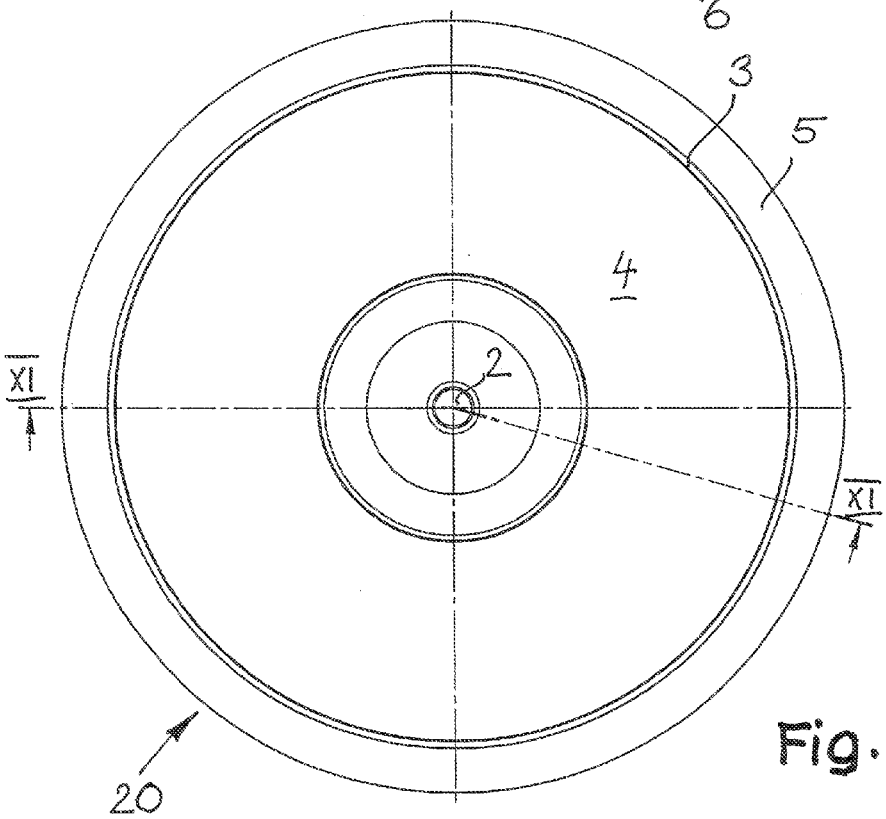
FIG. 12 is a plan view of the grinding disk according to FIG. 11.
Figure 13:
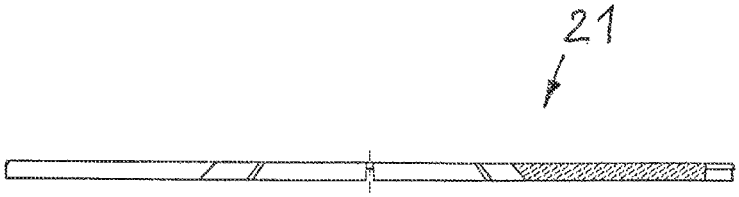
FIG. 13 is a cross-section of a fill element of the grinding disk according to FIGS. 11 and 12 (section according to section line XIII-XIII in FIG. 14).
Figure 14:
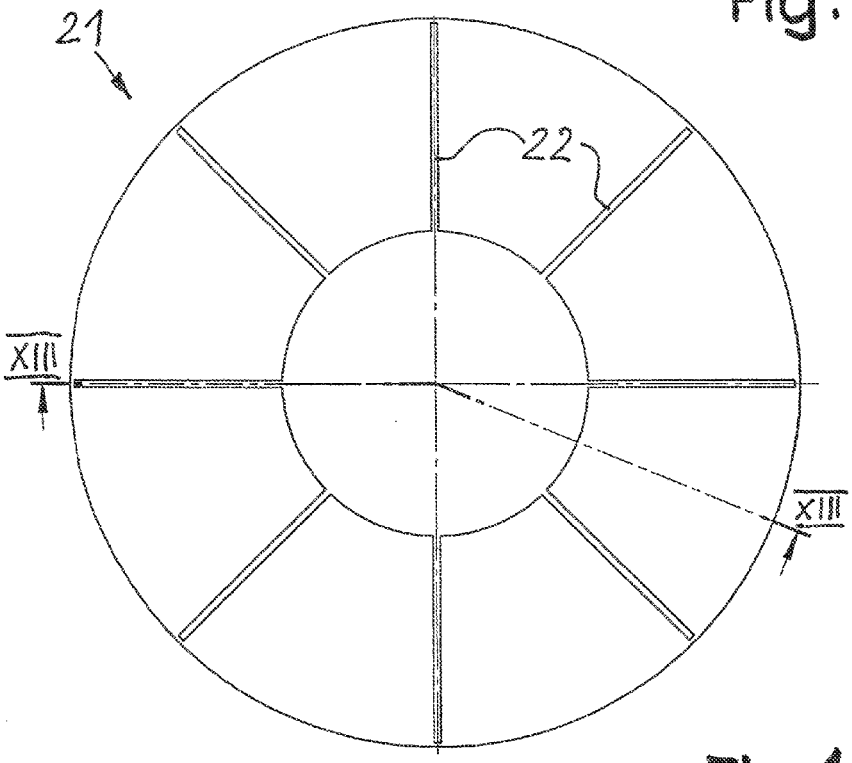
FIG. 14 is a plan view of the fill element according to FIG. 13.

A modified embodiment of the support plate according to the invention is illustrated in FIGS. 11 and 12 wherein a support plate 20 is comprised of the same structural components as the support plate 1 so that same parts are also provided with same reference characters. However, in the hollow spaces between support plate 3 and cover 4 a filling material of a light but stiff material, in particular a rigid plastic foam, is provided. This filling can be done with pre-manufactured fill members 21, as shown in FIGS. 13 and 14. The basic form is an annular disk which has spaces in the form of slots 22 for the radially extending webs. Inasmuch as the webs 12 of the support plate 3 are provided at some locations with rim cutouts, the fill member 21 can be formed as a contiguous part; otherwise, the fill member 21 is divided into several individual sector-shaped fill member parts.

Such a fill member can be glued into the intermediate spaces between support plate 3 and cover 4 and contributes then by means of the adhesive surfaces to the total strengthening. The support member can also be produced in situ from a material that can be foamed and that only after joining of support plate 3 and cover 4 will be foamed. Such a material is suitable and common in particular in the form of rigid polyurethane foam and attaches adhesively across the surface areas to the surrounding surfaces.

The specification incorporates by reference the entire disclosure of German priority document 20 2011 109 293.7 having a filing date of Dec. 20, 2011.

While specific embodiments of the invention have been shown and described in detail to illustrate the inventive principles, it will be understood that the invention may be embodied otherwise without departing from such principles.

What is claimed is:

1. A grinding disk in particular for rotary fine machining of surfaces, the grinding disk comprising:

a support plate having a top side and a bottom side, wherein the top side comprises an outer annular wall and an inner annular wall;

a drive connector adapted to connect the grinding disk to a rotary drive machine, the drive connector provided at the top side of the support plate, wherein the inner annular wall surrounds the drive connector at a radial spacing;

an elastically deformable cushion disposed at the bottom side of the support plate, the cushion having a bottom surface covered with a working medium or with an adhesive coating for detachable attachment of a working medium disk;

a cover disposed on the support plate so as to define an axial intermediate spacing, wherein the cover is annular and has an inner circumference and an outer circumference, wherein the inner circumference is fused or glued to the inner annular wall and the outer circumference is fused or glued to the outer annular wall and wherein the cover is a mechanically loadable structural part;

primarily radially extending ribs extending between the outer annular wall and the inner annular wall and disposed between the support plate and the cover and connected at least at some locations with the support plate and the cover.

2. The grinding disk according to claim 1, wherein the cover, the support plate, and the ribs are connected with each other by material fusion.

3. The grinding disk according to claim 1, wherein the ribs are fused or glued to the cover, the support plate; or the cover and the support plate.

4. The grinding disk according to claim 1, wherein the ribs are connected by fastening elements to the cover, the support plate; or the cover and the support plate.

5. The grinding disk according to claim 1, wherein the ribs are monolithically formed together with the cover or together with the support plate.

6. The grinding disk according to claim 1, wherein the cover is recessed into the support plate at the outer circumference so as to be flush with an upper end of the outer annular wall of the support plate and is resting in tight fit radially with an outer edge against an inner edge of the outer annular wall of the support plate.

7. The grinding disk according to claim 1, wherein the inner circumference of the cover is resting radially against an outwardly facing edge of the inner annular wall of the support plate.

8. The grinding disk according to claim 1, wherein between the cover and the support plate hollow spaces are defined between the ribs and the hollow spaces are filled with fill members of a strong but lightweight material.

9. The grinding disk according to claim 8, wherein the fill members are made of rigid plastic foam.

10. The grinding disk according to claim 9, wherein the rigid plastic foam is disposed in the hollow spaces as a foaming material and exhibits strong adhesion to the cover and the support plate.

11. The grinding disk according to claim 10, wherein the foaming material is a polyurethane foam.

12. The grinding disk according to claim 1, wherein the drive connector has at least one connecting element made of a high-strength material that is embedded at least circumferentially in the support plate.

13. The grinding disk according to claim 12, wherein the high-strength material is metal.

* * * * *